US007793784B2

(12) United States Patent
Nivala

(10) Patent No.: US 7,793,784 B2
(45) Date of Patent: Sep. 14, 2010

(54) CHILD RESISTANT TABLET PACKAGE

(75) Inventor: Michelle Nivala, St. Paul, MN (US)

(73) Assignee: Cima Labs, Inc., Eden Prairie, MN (US)

( * ) Notice: Subject to any disclaimer, the term of this patent is extended or adjusted under 35 U.S.C. 154(b) by 964 days.

(21) Appl. No.: 11/332,584

(22) Filed: Jan. 13, 2006

(65) Prior Publication Data

US 2006/0283760 A1 Dec. 21, 2006

Related U.S. Application Data

(60) Provisional application No. 60/644,262, filed on Jan. 14, 2005.

(51) Int. Cl.
*B65D 83/04* (2006.01)

(52) U.S. Cl. ..... 206/531; 206/1.5; 206/528; 206/538

(58) Field of Classification Search ..... 206/531, 206/528, 538, 1.5, 807, 828, 467, 468, 532
See application file for complete search history.

(56) References Cited

U.S. PATENT DOCUMENTS

| | | | | |
|---|---|---|---|---|
| 3,941,248 | A * | 3/1976 | Moser et al. | 206/531 |
| 4,120,400 | A | 10/1978 | Kotyuk | |
| 4,158,411 | A | 6/1979 | Hall et al. | |
| 4,364,488 | A * | 12/1982 | Anjou | 220/281 |
| 5,178,878 | A | 1/1993 | Wehling et al. | |
| 5,223,264 | A | 6/1993 | Wehling et al. | |
| 5,234,957 | A | 8/1993 | Mantelle | |
| 5,275,291 | A * | 1/1994 | Sledge | 206/531 |
| 5,878,887 | A * | 3/1999 | Parker et al. | 206/528 |
| 6,036,018 | A * | 3/2000 | Harrold | 206/536 |
| 6,047,829 | A | 4/2000 | Johnstone et al. | |
| 6,155,423 | A | 12/2000 | Katzner et al. | |
| 6,230,893 | B1 | 5/2001 | Karow | |
| 6,412,636 | B1 * | 7/2002 | Jones et al. | 206/532 |
| 6,460,693 | B1 * | 10/2002 | Harrold | 206/1.5 |
| 6,752,272 | B2 | 6/2004 | Jones et al. | |
| 6,874,636 | B2 * | 4/2005 | Paliotta et al. | 206/531 |
| 2003/0102321 | A1 * | 6/2003 | Maietta | 220/824 |
| 2005/0183981 | A1 * | 8/2005 | Gelardi | 206/531 |
| 2006/0138016 | A1 * | 6/2006 | Harper | 206/532 |
| 2006/0278558 | A1 * | 12/2006 | Nivala | 206/538 |

FOREIGN PATENT DOCUMENTS

| | | |
|---|---|---|
| EP | 1293436 | 3/2003 |
| WO | WO 2004037657 A2 * | 5/2004 |

OTHER PUBLICATIONS

Supplementary European Search Report, EP 06 71 8547.
MeadWestvaco Healthcare Packaging Advertisement for shellpak Plastic Blister Housing.
Alcan Packaging Presentation of CR Concepts for F=1 for Cima Labs, May 15, 2002, 10 pages.

* cited by examiner

*Primary Examiner*—Mickey Yu
*Assistant Examiner*—Steven A. Reynolds

(57) ABSTRACT

A child resistant package for tablets is disclosed. The package includes an outer sleeve and a blister package. The blister package is designed to fit within the outer sleeve, and is capable of being slid from a closed position to an open position. The blister package includes a blister sheet and a lidding material sheet that is peeled from the blister sheet to access the tablets.

18 Claims, 5 Drawing Sheets

CHILD RESISTANT TABLET PACKAGE

CROSS-REFERENCE TO RELATED APPLICATIONS

This application claims the benefit of the filing date of U.S. Provisional Patent Application No. 60/644,262 filed Jan. 14, 2005, the disclosure of which is hereby incorporated herein by reference.

BACKGROUND OF THE INVENTION

Many people, as part of their daily routine, take various types of medication. Some may take several different types of pharmaceutical dosage forms in a given period. These pharmaceutical dosage forms may include pills, capsules, tablets, liquids and the like. As with many industries for which a tangible product is offered for sale, packaging is an issue. Often times, the manner in which a product is offered is a deciding factor in whether or not a purchase is made. This situation is no different in the pharmaceutical field. But other concerns may also drive the style of packaging in the pharmaceutical industry.

One packaging concern is the nature of the dosage form. Some tablets, for example, are frangible, friable or breakable (used synonymously). Such dosage forms may be easily damaged both during transport of the package and by a user upon opening. The disclosures of commonly assigned U.S. Pat. Nos. 5,178,878 and 5,223,264, which are hereby incorporated by reference herein, describe relatively soft tablets which are susceptible to this type of damage. Tablets which fall into this category tend to have a low hardness and may include very soft tablets with a hardness below about 15 Newtons.

Standard dosage forms are typically packaged in blister packages, which are comprised of multi-layered sheets of material having pockets, blisters or wells for containing the dosage forms. One type of conventional blister packages include packages having a foil layer through which a user of the package must push the tablet, thereby breaking the foil. An example of such a conventional blister package is shown in U.S. Pat. No. 4,158,411 to Hall et al, the disclosure of which is hereby incorporated by reference herein. While this type of package is sufficient for packaging standard dosage forms, packaging of frangible dosage forms in such a package would cause damage to the frangible dosage form when attempting to push it through the foil layer. These types of packages are also generally not child proof.

Another concern with the packaging of pharmaceutical dosage forms, whether they are frangible dosage forms or not, relates to safety. Child proof or child resistant packaging is often very desirable for the packaging of dosage forms. Clearly, a big concern with having medication in the home is the possibility of a child gaining access to it. On the other hand, child-proof packages may also be quite difficult to open by the elderly, handicapped or people in great pain. There needs to be a balance struck, therefore, between safety and ease of use. Packages that are more difficult for children to open than, for example, the elderly are therefore highly desirable. In addition, not all child proof packaging is the same. Packaging is often rated based on the number of children who can gain access to the drug in five minutes. One example of testing procedure standards for achieving these ratings is set forth in 16 C.F.R., and in particular §1700.00 through 1700.20 thereof.

Therefore, there exists a need for a frangible dosage package that is easy to open by the elderly or the like and child proof, while still being configured to prevent damage of the dosage that the package is designed to store.

SUMMARY OF THE INVENTION

The present invention relates to packages for non-frangible and frangible pharmaceutical dosage forms, more particularly, child resistant packaging for frangible pharmaceutical dosage forms that is easily operable by elderly or otherwise handicapped persons.

A first aspect of the present invention is a medication package comprising a blister package and a substantially rigid outer sleeve for receiving the blister package. The blister package includes a unitary blister sheet defining at least one, and more preferably, a plurality of unit package regions, each of the unit package regions including a recess having an open top and a flange surrounding the recess, and a unitary sheet of lidding material peelably sealed to the flanges, the sheet of lidding material having lines of weakness extending at least partially along borders between adjacent unit package regions, the blister sheet and the sheet of lidding material defining unsealed areas along the borders for facilitating peeling of the lidding material from the blister sheet. However, it is contemplated that other embodiments may include unsealed areas that are not situated along the borders. The outer sleeve includes at least one opening, locking means for locking the blister package within the sleeve, release means for releasing the blister package from the locking means, and retaining means for preventing the blister package from being completely withdrawn from the sleeve.

Particularly preferred blisters and blister containing cards or sheets are those described in commonly assigned U.S. Pat. No. 6,155,423 to Katzner et al. ("the 423 patent), the disclosure of which is hereby incorporated by reference herein. The frangible dosage forms disposed in each recess of the preferred blisters engages the walls of each recess so that the walls hold the dosage form away from the bottom of the recess and adjacent the lidding material. This aspect protects the dosage form from damage by preventing shifting of the dosage form during transport. An empty space between each dosage form and the bottom of the recess in which the dosage form is disposed cushions the dosage form from impact when the package is dropped. The recesses of the package and the dosage forms disposed in the recesses may have essentially any shape. For example, the dosage forms may be disk-shaped tablets, oblong capsules or square-shaped pills. Shapes for recesses include circular, oblong, polygonal or star shapes in the plane of the blister sheet.

Furthermore, the walls and bottom of the recesses may define a shape in the form of a surface of revolution, about a vertical axis normal to the flange surrounding each of the recesses. For example, the recesses may have a curved, cup-like shape. Where the dosage forms are disc-shaped, they may each have an edge which contacts the walls of the recess in which each dosage form is disposed. The edge and walls define an annular region of contact coaxial with the vertical axis of the recess. The edge of such a disc-shaped dosage form may comprise a bevel which contacts the walls of the recess. The annular region of contact prevents shifting of the dosage form within the blister and the damage to the dosage form associated with such shifting.

Another embodiment of the present invention is a blister package comprising a unitary blister sheet defining one or more unit package regions, each of the unit package regions including a recess having an open top and a flange surrounding the recess; a unitary sheet of lidding material peelably sealed to the flanges, the sheet of lidding material having lines of weakness extending along borders between adjacent unit package regions, the blister sheet and the sheet of lidding material defining unsealed areas along the borders for facilitating peeling of the lidding material from the blister sheet; and a connection section including an aperture for engaging a protrusion Yet another embodiment of the present invention is a medication package comprising a blister package and a substantially rigid outer sleeve for receiving the blister package. The blister package includes a blister sheet defining a plurality of unit package regions, each of the unit package regions including a recess having an open top and a flange surrounding the recess, lidding material for covering the recesses peelably sealed to the flanges, and an aperture passing through the blister sheet. The outer sleeve includes at least one opening, a post, or similar structure that extends from an internal surface of the outer sleeve through the aperture to secure the blister package within the outer sleeve, and a depressible section of the outer sleeve for engaging the blister package and moving the aperture off of the post.

Yet another aspect of the present invention is a method of removing a frangible dosage form from a package comprising providing a package having an inner blister package housed in a substantially rigid outer sleeve; engaging a release to allow the inner blister package to move from a first position in a direction through an opening in the outer sleeve; moving the inner blister package to a second position, whereby the inner blister package is partially removed from the outer sleeve; preventing the inner blister package from being completely removed from the outer sleeve; pealing away a lidding material on the inner blister package to allow access to at least one frangible dosage; and removing the frangible dosage from the inner blister package.

In a particularly preferred aspect of the present invention, the packaging can be rated as a highly child resistant package such a package generally referred to in the industry as "F4", "F3", "F2" or "F1" while also being easy to use by the elderly and such. These monikers may be given to packages that pass certain tests relating to how many children can gain access to the dosage forms housed in the packages in a certain amount of time. Typically, the number following the "F" refers to the number of tablets that would cause serious personal injury or serious illness to a twenty five pound child if ingested. For example, one such test begins with a base of fifty children, their goal being to access the dosage form housed in the package. The children are first given the packages without instructions to access the dosage forms. The children are given five minutes to attempt to gain access. After the five minutes expires, the children are asked to stop, at which point they are shown the proper steps to take in order to gain access to the dosage forms. Thereafter, the children are given an additional five minutes to work with the package. According to this one test, an F1 package would be one in which no more than five children can gain access to one pill during the ten minute period. A package would be given the F2 label if no more than five children can gain access to two pills. And, an F3 package would be one in which no more than five children can gain access to three pills in the ten minute period. While the above described test is one well known test utilized by the packaging industry, there are clearly many different tests that can be conducted in order to properly rate packages. These tests are generally done in accordance with 16 C.F.R. §1700.00-1700.20.

DETAILED DESCRIPTION

Figure 1:
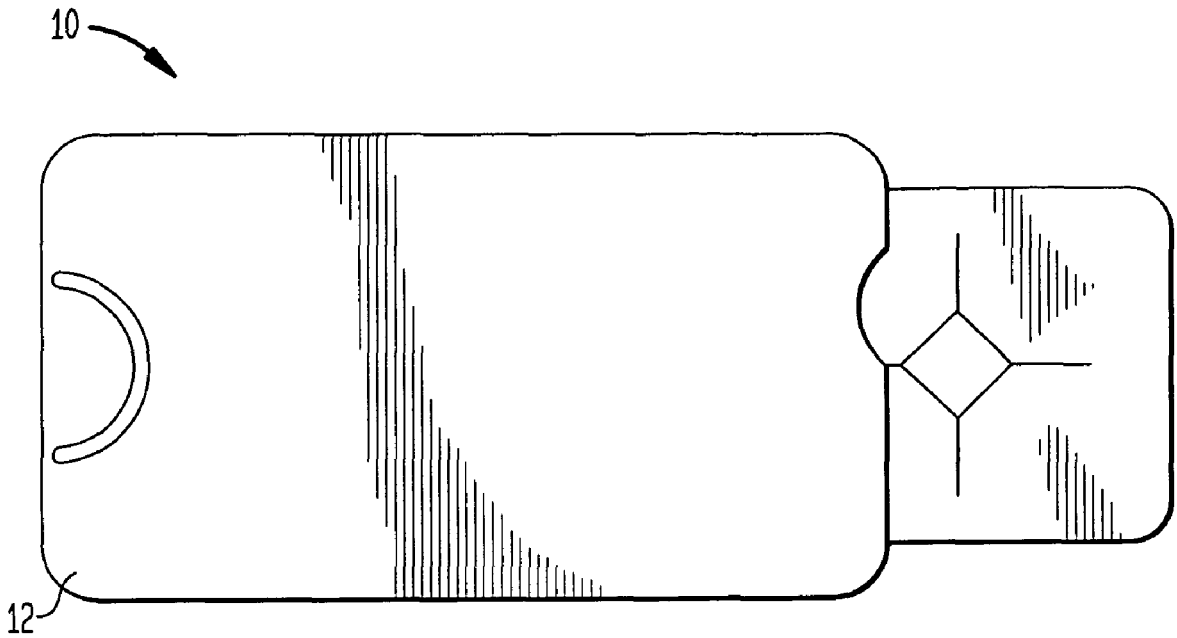
FIG. 1 is a top plan view of a child resistant tablet package according to an embodiment of the present invention showing the package's outer sleeve and a blister package partially extended from the tablet package's outer sleeve.
Figure 2:
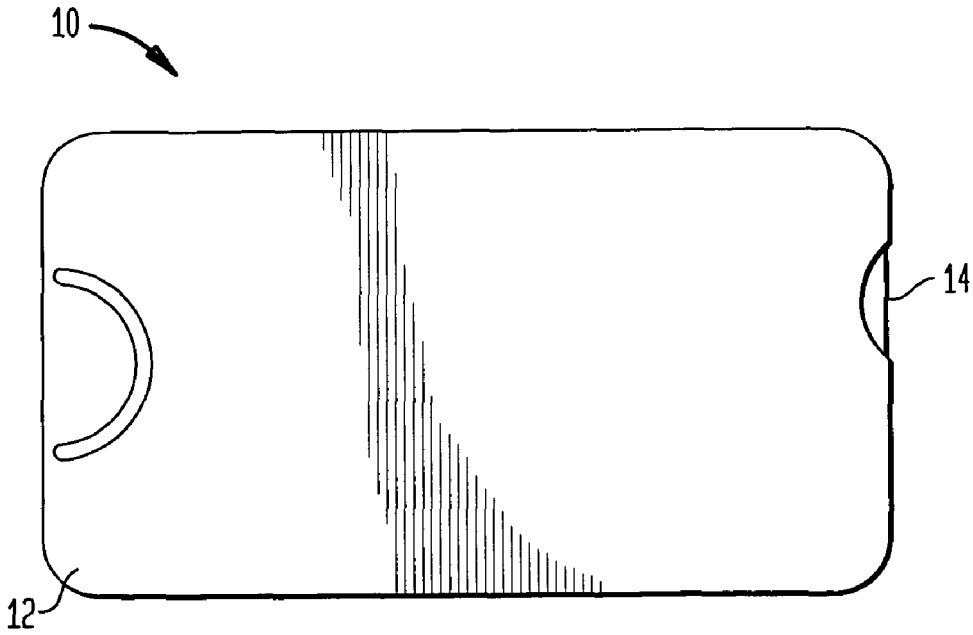
FIG. 2 is a top plan view of the tablet package of FIG. 1 with the blister package substantially disposed within the outer sleeve.

A child resistant tablet package 10 in accordance with an embodiment of the present invention is shown in FIGS. 1 and 2. Tablet package 10 is a child resistant container for non-frangible and frangible tablets that is also easily accessible. Tablet package 10 includes outer sleeve 12 and blister package 14. Outer sleeve 12 is preferably molded from a polymeric material, but can be made of any material suitable for providing a rigid outer covering. Package 10, on the other hand, is configured so that each tablet is packaged separately from each other in blister package 14. Blister package 14 may be moved within sleeve 12 from a position substantially extended from outer sleeve 12 (as shown in FIG. 1) to a position substantially disposed within outer sleeve 12 (as shown in FIG. 2). However, outer sleeve 12 preferably prevents blister package 14 from being completely removed from the outer sleeve.

Figure 3:
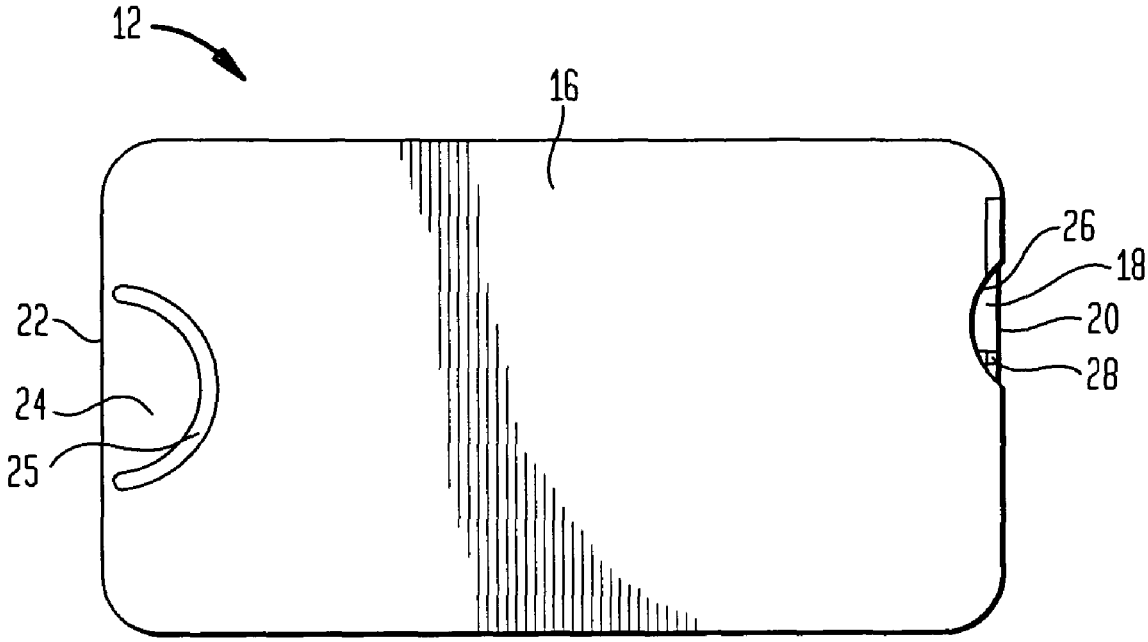
FIG. 3 is a top plan view of the outer sleeve of FIG. 1 without the blister package disposed therein.
Figure 4:
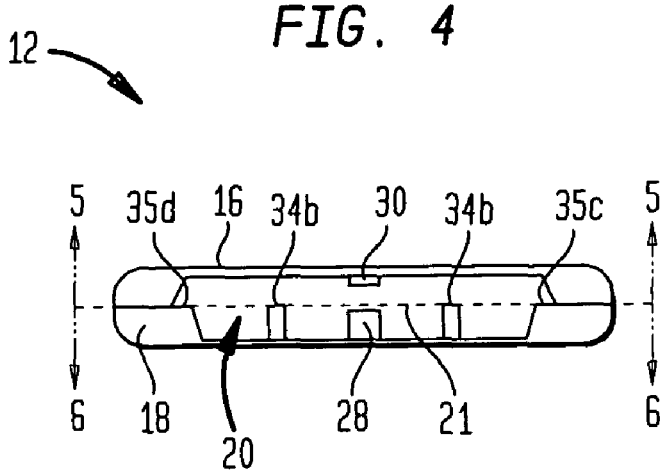
FIG. 4 is a right side view of the outer sleeve of FIG. 1 showing the outer sleeve's open end.

FIGS. 3-6 illustrate outer sleeve 12. This sleeve includes top portion 16 and bottom portion 18 which form interior 21 for housing blister package 14. Outer sleeve 12 further includes open end 20 and closed end 22. Open end 20 provides access to interior 21 (best shown in FIG. 4). As is shown in FIG. 3, outer sleeve 12 may also include flexible release 24 and indentation 26 located on top portion 16, and locking member 28 located on the top internal surface of bottom portion 18. These features will be discussed in more detail below.

Figure 5:
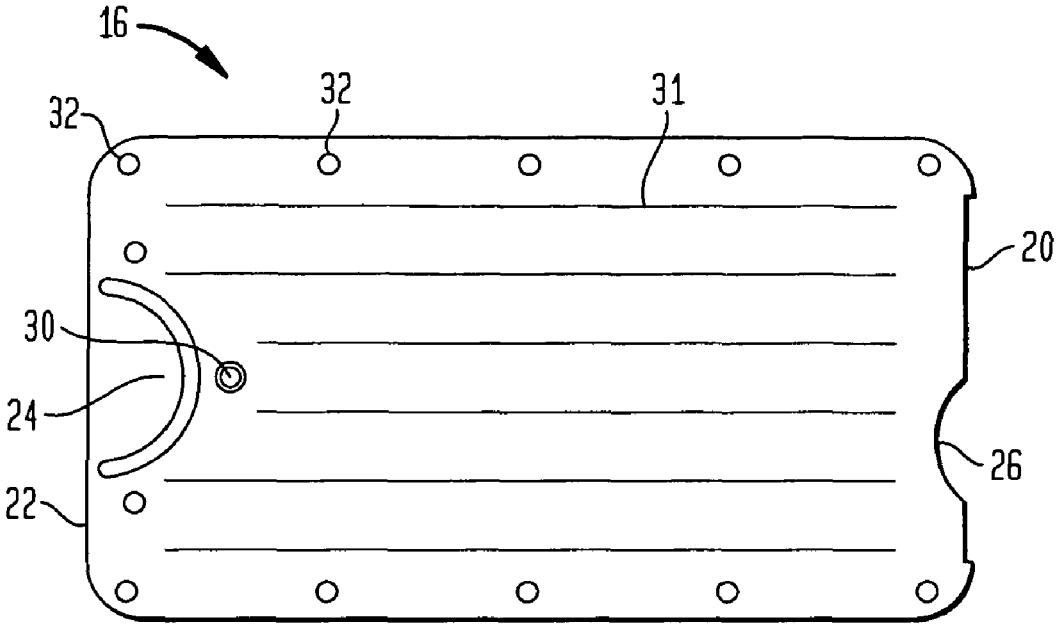
FIG. 5 is a cross-sectional view taken along line 5-5 of FIG. 4 showing the bottom internal surface of the top portion of the outer sleeve.
Figure 6:
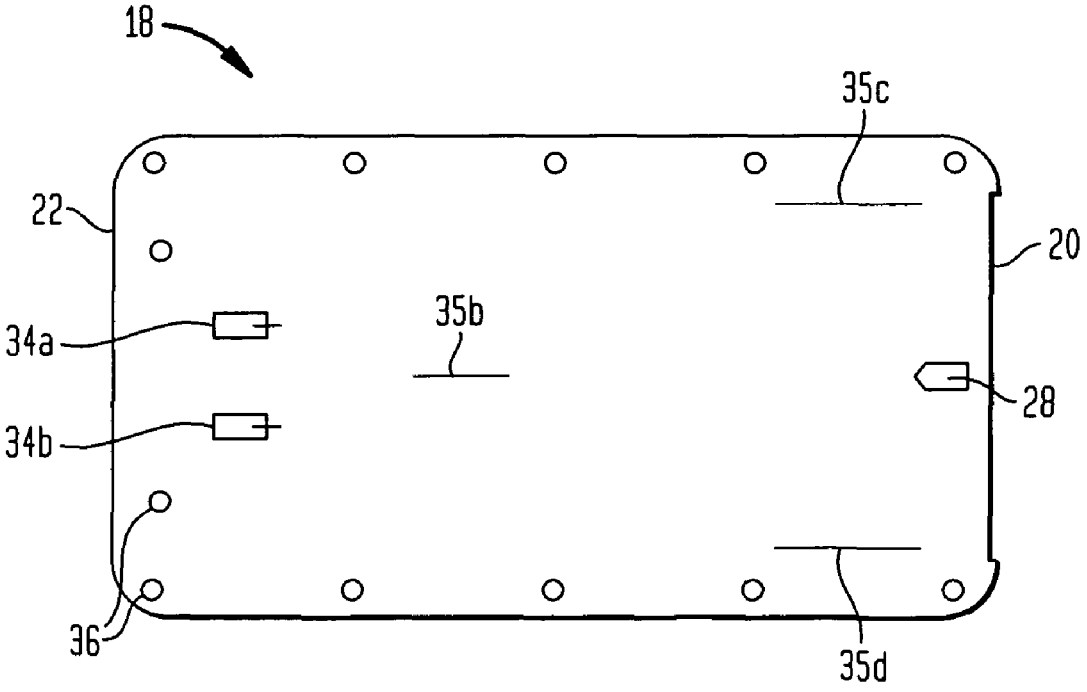
FIG. 6 is a cross-sectional view taken along line 6-6 of FIG. 4 showing the top internal surface of the bottom portion of the outer sleeve.

FIGS. 5 and 6 show the bottom internal surface of top portion 16 and the top internal surface of bottom portion 18, respectively. As shown in FIG. 5, the bottom internal surface of top portion 16 includes locking post 30, a plurality of ribs 31 extending longitudinally between open end 20 and closed end 22, and a plurality of hollow posts 32. Locking post 30 is a post located in front of release 24 that is angled toward closed end 22. As shown in FIG. 6, the top internal surface of bottom portion 18 includes flexible guides 34*a* and 34*b*, ribs 35*a-d*, locking member 28 and a plurality of solid posts 36. In the embodiment shown, hollow posts 32 are configured and dimensioned to receive solid posts 36 for attaching top portion 16 to bottom portion 18. However, it is contemplated that the hollow and solids posts may be situated on different portions. For example, bottom portion 18 may include hollow posts 32, while top portion 16 includes solid posts 36. Additionally, different structures could be utilized to attach top portion 16 to bottom portion 18.

Flexible guides 34*a* and 34*b* are preferably curved flexible fingers extending upwardly from the top internal surface of bottom portion 18 toward closed end 22. Ribs 35*a-d* extend longitudinally in the same direction as ribs 31 of top portion 16. However, ribs 35*a-d* extend longitudinally for shorter distances than ribs 31 and are taller than ribs 31. Ribs 35*a-d* are configured along bottom portion 18 to aid in retaining blister package 14 within outer sleeve 12. Locking member 28 is a flexible finger extending upwardly from the top internal surface of bottom portion 18 toward closed end 22.

Referring to FIG. 3, release 24 is created by forming curved slot 25 in top portion 16. However, it is contemplated that differently shaped slots can also be utilized. For example, a square shaped slot. These slots create a depressible button or lever operable by a user. Indentation 26 allows a user to gain access to and grasp blister sheet 14 when the blister sheet is fully disposed within outer sleeve 12 as shown in FIG. 2. Indentation 26 is dimensioned to allow for grasping of blister package 14 by the thumb and forefinger of a user.

Figure 7:
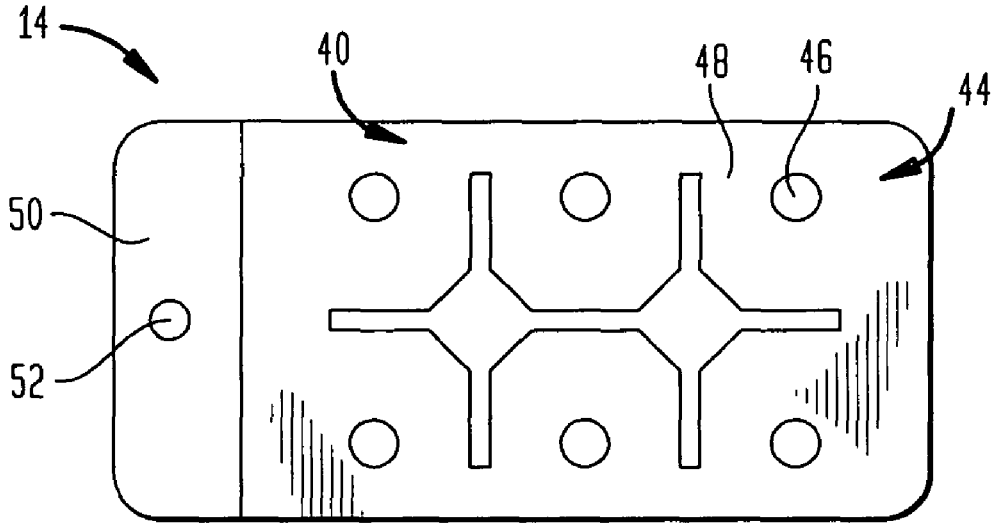
FIG. 7 is a top plan view of the blister package of FIG. 1.
Figure 8:
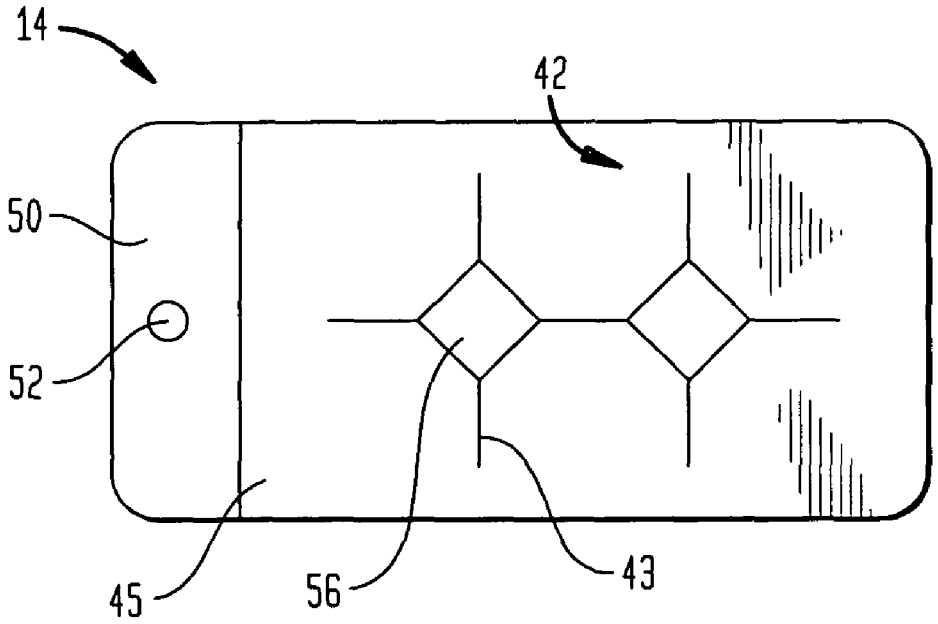
FIG. 8 is a bottom plan view of the blister package of FIG. 1.
Figure 9:
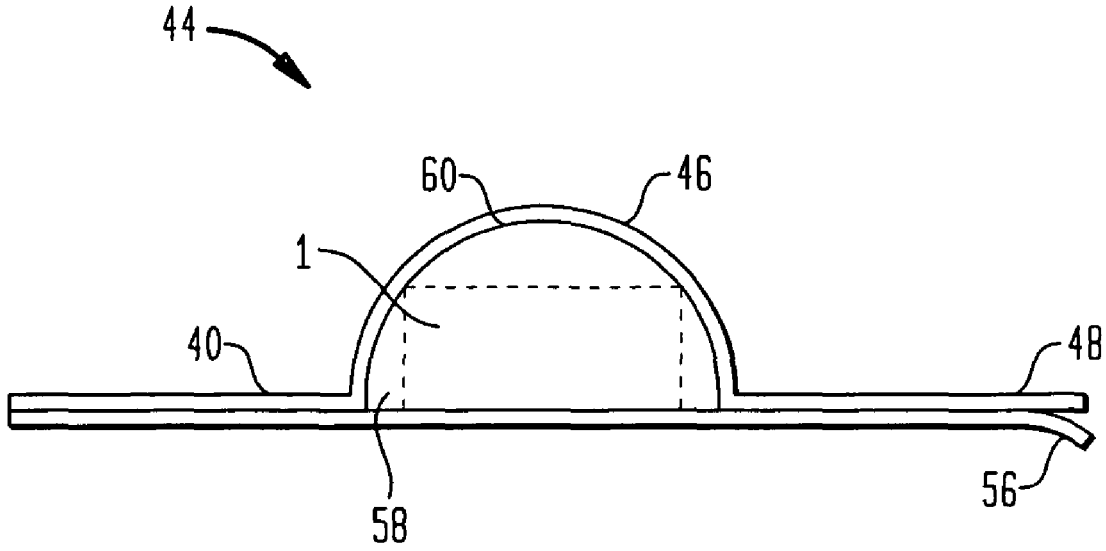
FIG. 9 is a side view of a unit package region of the blister package of FIG. 1.

FIGS. 7-9 illustrate blister package 14. Blister package 14 may be a modified version of the blister package disclosed in the '423 patent that discloses a blister package having a peelable layer, which when pealed away, allows for access to the dosage form. Thus, the '423 patent provides a user accessibility to his or her frangible dosage form without the possibility of damaging the dosage form. The blister is also designed to help protect the tablet during storage, shipment and use. Nevertheless, certain modifications to the blister package disclosed herein preferably enable blister package 14 to interact and cooperate with outer sleeve 12 to form child resistant tablet package 10. The modifications to blister package 14 also preferably prevent the individual package regions from being torn away from the whole of blister package 14. This, in turn, prevents the inadvertent removal of blister package 14 from outer sleeve 12, as removal of package regions might allow for blister package 14 to more easily become dislodged from outer sleeve 12. This would typically occur due to the now improperly sized blister package 14 being able to move around inside of outer sleeve 12.

In certain preferred embodiments, blister package 14 is formed by blister sheet 40 and lidding material sheet 42, shown in FIGS. 7 and 8 respectively. Blister sheet 40 preferably includes a plurality of unit package regions 44, each unit package region including a recess 46 and a flange 48 surrounding the recess (shown in FIGS. 7 and 9). As shown in FIG. 7, blister sheet 40 includes six package regions 44, although any number of package regions 44 can be included. Blister sheet 40 may be constructed from any suitable type of material. For example, blister sheet 40 may be constructed of material supplied by Alcan Pharma Center of Shelbyville, Ky. ("Alcan") and offered as PCS technical and material specification no. 92011 ("the 92011 material) having a thickness of approximately 205 μm. The 92011 material includes several different individual layers, for example, approximately 60 μm of PVC film, approximately 25 μm of polyamide file, approximately 60 μm of aluminum foil and approximately 60 μm of additional PVC film, which are preferably at least joined together by suitable adhesives. As shown in FIG. 9, each recess 46 is dimensioned and configured to house a tablet 1, and includes an open top 58 and a closed bottom 60. It is contemplated that the design of the blister package, as similarly disclosed in the '423 patent, also provides protection for the frangible dosage forms by including recesses that cooperate with the dosage forms to prevent shifting of the dosage forms during transport and/or cushioning in the event of impact from the dropping of the package.

Lidding material sheet 42 is a unitary sheet that overlies recesses 46 and is peelably attached to flanges 48, thereby covering the tablet housed in the recesses. Lidding material sheet 42 may be constructed from any suitable type of material. For example, PCS technical and material specification nos. 15144 having a thickness of approximately 37 μm or 15127 having a thickness of approximately 37 μm. Both of these materials are also supplied by Alcan, and preferably include a paper layer, an approximately 12 μm thick polyester film, an approximately 25 μm thick aluminum foil layer and a heat seal coating. It is contemplated that lidding material sheet 42 may be attached to flanges 48 through the use of an adhesive. For example, certain embodiments utilize adhesive supplied by Alcan under the numbers 4563 or 4516. However, it is also contemplated that other modes of attaching lidding material sheet 42 to flanges 48 can be utilized, and that the strength of the attachment mode can be varied to determine the difficulty required to remove the lidding material.

The unitary lidding material sheet 42 also preferably includes lines of weakness 43 that correspond to package regions 44, thereby creating individual lidding sections 45 for each package region 44. In the embodiment shown in the figures, lines of weakness 43 do not extend to the edges of blister package 14. This ensures that there is no inadvertent creation of perforations through blister sheet 40 and thus entire package regions 44 cannot be easily separated from each other. In the alternative, individual sheets of lidding material may be used to individually cover each package region 44. Lidding material sheet 42 further includes unsealed areas 56, where the lidding material is not firmly attached to blister sheet 40. These unsealed areas provide a section of the lidding material sheet 42 that can be grasped by a user to aid in the peeling of an individual lidding section 45 from the corresponding package region 44. This peeling in turn allows tablet 1 to be removed through open top 58 of blister sheet 40. To provide enhanced security for blister package 14, unsealed areas 56 can be configured so that they can be grasped only upon the deformation of blister package 14. For example, unsealed areas 56 can be configured so that they can be grasped only when blister package 14 is bent along lines of weakness 43. It is noted, however, that lines of weakness 43 should preferably never extend through blister sheet 40.

Blister package 14 further includes connection section 50 for cooperating with outer sleeve 12. Connection section 50 preferably includes locking aperture 52 located at a central portion thereof. This aperture is configured to work in corporation with locking member 28 and locking post 30 of bottom portion 18 and top portion 16, respectively.

In certain embodiments of the present invention, frangible dosage forms may be disposed in each recess 46 of blister sheet 14 such that the dosage forms engage the walls of each recess 46, and the walls hold the dosage form away from closed bottom 60 of recess 46 and adjacent lidding material 42. Such a configuration is best shown in FIG. 9. This aspect protects the dosage form from damage by preventing shifting of the dosage form during transport. An empty space between each dosage form and closed bottom 60 of the recess 46 in which the dosage form is disposed cushions the dosage form from impact if and when package 10 is dropped. Recesses 46 and the corresponding dosage forms disposed in recesses 46 may have essentially any shape. For example, the dosage forms may be disk-shaped tablets, oblong capsules or square-shaped pills. Shapes for recesses 46 include circular, oblong, polygonal or star shapes in the plane of the blister sheet.

Furthermore, the walls and closed bottom 60 of recess 46 may define a shape in the form of a surface of revolution, about a vertical axis normal to flange 48 surrounding each of the recesses 46. For example, recesses 46 may have a curved, cup-like shape. Where the dosage forms are disc-shaped, they may each have an edge which contacts the walls of recess 46 in which each dosage form is disposed. The edge and walls define an annular region of contact coaxial with the vertical axis of recess 18. The edge of such a disc-shaped dosage form may comprise a bevel which contacts the walls of recess 46. The annular region of contact prevents shifting of the dosage form within the blister and the damage to the dosage form associated with such shifting.

Blister package 14 is slid into outer sleeve 12 over locking member 28 such that the exposed surface of blister sheet 40 faces bottom portion 18 and the exposed surface of lidding material sheet 42 faces top portion 16. Locking member 28 guides blister package 14 towards top portion 16. When disposed within outer sleeve 12, blister package 14 is supported by longitudinally extending ribs 31 of top portion 16, flexible guides 34*a* and 34*b* of bottom portion 18 and longitudinally extending ribs 35*a-d* of bottom portion 18. These elements also preferably guide locking aperture 52 of blister package 14 onto locking post 30 of top portion 16 when blister package 14 is fully inserted into outer sleeve 12.

When blister package 14 is fully inserted into outer sleeve 12, the engagement of locking aperture 52 with locking post 30 prevents the removal of blister package 14 from outer sleeve 12. As a result, none of the package regions 44 can be accessed by a user, and none of tablets 1 can be removed from blister package 14.

In order to remove blister package 14 from outer sleeve 12, the user presses release 24 downwardly to engage and move downwardly connection section 50 of the blister package. This movement causes flexible guides 34*a* and 34*b* to also move downwardly such that locking aperture 52 is disengaged from locking post 30. By grasping the portion of blister package 14 made accessible by indentation 26, the user now can pull blister package 14 out of open end 20 of outer sleeve 14.

When released from locking post 30, blister package 14 can be pulled from outer sleeve 14 such that all or only a selected number of package regions 44 can be accessed. However, the user may not completely remove blister package 14 from outer sleeve 12. in this regard, locking member 28 preferably engages locking aperture 52 before the blister package can be completely removed and holds the blister package within the outer sleeve in a final, nearly fully extended position. Therefore, once blister package 14 is slid into outer sleeve 12, the blister package cannot be removed. However, blister package 14 can be freely moved between a fully inserted, locked position where none of package regions 44 can be accessed to various extended positions where one or more of these regions can be accessed.

Upon exposing a package region 44 containing tablet 1, the user peels off the individual lidding section 45 of lidding material sheet 42 from the package region to obtain access to the tablet. The user then pushes blister package 14 back into outer sleeve 12 to prevent further access to the blister package and protect the blister package from damage. The steps described above to obtain access to the blister package, and the inability to fully remove the blister package from the outer sleeve, make tablet package 10 highly child resistant.

Figure 10:
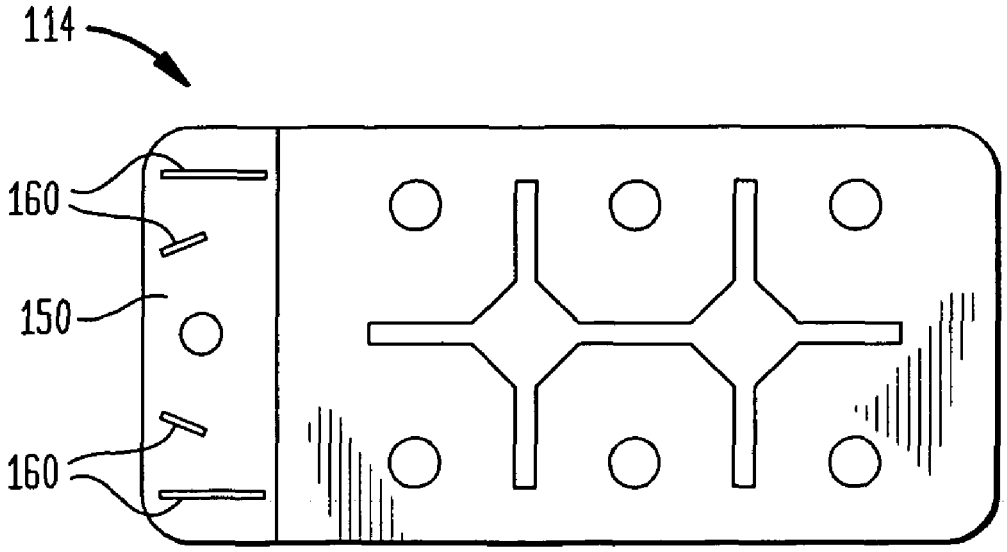
FIG. 10 is a top plan view of a blister package according to another embodiment of the present invention.

FIG. 10 depicts a blister package 114 according to another embodiment of the present invention. Blister package 114 is essentially the same as blister package 14 except for the addition of several stabilizing ribs 160 located in connection section 150. Stabilizing ribs 160 may allow for a snugger and more balanced fit for blister package 114 within outer sleeve 12. It is contemplated that stabilizing ribs 160, while shown in FIG. 10 as only being located in connection section 150, can be located at any area of blister package 114. For example, stabilizing ribs 160 may be located along edges section of blister package 114.

The tablet packaging according to the present invention is designed to be both elderly friendly and child resistant. The packaging can be rated as a highly child resistant package or better. Indeed, tablet package 10 is designed to prevent a relatively high amount of children from accessing the drug in a given time. Certain embodiments according to the present invention may be rated as high as the well known industry standard known as F1 packaging, as discussed above. For example, a package containing a blister card as dimensioned and made using the materials discussed above and an adhesive designated as adhesive No. 4516 from Alcan, in order to provide an "F1" package. Other embodiments may on the other hand achieve an F2 or F3 rating. Different embodiments are therefore envisioned for housing different types of dosage forms. While the present invention has been discussed with respect to frangible or friable dosage forms, it is also contemplated that other types of dosage forms may also be housed. Of course, it is noted that a user should select proper packaging for the particular active. For example, highly dangerous or poisonous dosage forms should be packaged in a highly child resistant package, while less dangerous dosage forms may be packaged in less child resistant packages.

Finally, one preferred formation method of the aforementioned blister packages 14, 114 and the packaging process of dosages forms 1 therein will be described. It is to be understood that many different suitable processes may be utilized in accordance with the present invention, and the following is but one preferred method. In such a method/process, sheets of material for forming blister sheet 40 and lidding material 42 are preferably received in roll form and fed or loaded onto a blister machine. It is noted that such machines are well-known in the art. The material forming blister sheet 40 is then preferably moved to a forming station where recesses 46 are formed into the material by tools such as forming plugs. Tablets 1 are then preferably placed into each open recess 46 of blister sheet 40.

With recesses 46 each containing one or more tablets or other dosage forms, blister sheet 40 is then preferably moved to a sealing station where upper and lower sealing plates may be utilized to seal lidding material 42 to blister sheet 40. The aforementioned sealing plates preferably utilize heat and pressure over the course of a certain dwell time (cycles/speed) to heat a suitable adhesive (like those described above) to seal lidding material 42 to blister sheet 40. Subsequent to this sealing step, desired perforations may be formed in the package, and individual blister cards 14 (with multiple recesses 46) may be punched out. It is noted that the formed perforations may be useful in this punch out procedure, but may also remain in the final blister package 14 as discussed above. Ultimately, the individual packages 14 are preferably delivered to final packaging stations via conveyors or the like.

The dosage forms, usually tablets, which can be packaged using the present invention are not at all limited by the type of tablet or the type of active pharmaceutical ingredient ("API") used therein. These API's include, without limitation, analgesics, anti-inflammatories, antipyretics, antibiotics, antimicrobials, anxiolytics, laxatives, anorexics, antihistamines, antidepressants, antiasthmatics, antidiuretics, antiflatuents, antimigraine agents, antispasmodics, sedatives, antihyperactives, antihypertensives, tranquilizers, decongestants, beta blockers, peptides, proteins, oligonucleotides and other substances of biological origin, and combinations thereof. Also contemplated are the drugs and pharmaceutically active ingredients described in Mantelle, U.S. Pat. No. 5,234,957, in columns 18 through 21. That text of Mantelle is hereby incorporated by reference. Any of the forgoing API's can be used in the form of any salt, hydrate, solvate, polymorph, or individual optical isomer, and any mixture thereof.

In particular, opiates, drugs used to treat pain, drugs used in psychiatry or in the treatment of schizophrenia, such as clozapine and cytotoxic substances are particularly preferred. Also preferred is any API which is intended to treat the elderly or any API which requires the use of a child-proof package, and more particularly an "F1" package.

Legal opiates which may be packaged according to the invention include prescription drugs such as, without limitation, alfentanil, alphaprodine, anileridine, benzylmorphine, bezitramide, buprenorphine, butorphanol, clonitazene, codeine, codeine phosphate, desomorphine, dextromoramide, dezocine, diampromide, dihydrocodeine, dihydrocodeinone enol acetate, dihydromorphine, dimenoxadol, dimepheptanol, dimethylthiambutene, dioxaphetyl butyrate, dipipanone, eptazocine, ethoheptazine, ethylmethylthiambutene, ethylmorphine, etonitazene, fentanyl, hydrocodone, hydromorphone, hydroxypethidine, isomethadone, ketobemidone, levorphanol, lofentanil, meperidine, meptazinol, metazocine, methadone, metopon, morphine, morphine hydrochloride, morphine sulfate, myrophine, nalbuphine, narceien, nicomorphine, norlevorphanol, normethadone, normorphine, norpipanone, opium, oxycodone, oxymorphone, papveretum, pentazocine, phenadoxone, phenazocine, phenoperidine, piminodine, piritramide, proheptazine, promedol, propirm, propoxyphene, remifentanil, sufentanil and tilidine. The class of compounds generally known as opiates also includes illicit drugs such as heroin and cocaine. Opiates in accordance with the present invention include those identified above as well as any listed as controlled substances pursuant to 21 C.F.R. §1308.12. Opiates are given to patients for a variety of reasons, most frequently for pain mitigation of one type or another.

A cytotoxic substance includes any agent that kills cells. These substances are generally used in the treatment of malignant and other diseases. They are designed to destroy rapidly growing cancer cells. They have been shown to be mutagenic, carcinogenic and/or teratogenic, either in treatment doses or animal and bacterial assays. Cytotoxic drugs that interfere with critical cellular processes including DNA, RNA, and protein synthesis, have been conjugated to antibodies and subsequently used for in vivo therapy. Such drugs, include, but are not limited to:

i) intercalating agents, in particular doxorubicin (Adriamycin), daunorubicin, epirubicin, idarubicin, zorubicin, aclarubicin, pirarubicin, acridine, mitoxanthrone, actinomycin D, eptilinium acetate;

ii) alkylating agents chosen from platinum derivatives (cisplatin, carboplatin, oxaliplatin);

iii) a compound chosen from the other groups of alkylating agents: cyclophosphamide, ifosfamide, chlormetrine, melphalan, chlorambucil, estramustine, busulfan, mitomycin C, nitrosoureas: BCNU (carmustine), CCNU (lomustine), fotemustine, streptozotocin, triazines or derivatives: procarbazine, dacarbazine, pipobroman, ethyleneimines: altretamine, triethylene-thio-phosphoramide, iv) a compound chosen from the other groups of antimetabolic agents: antifolic agents: methotrexate, raltitrexed, antipyrimidine agents: 5-fluorouracil (5-FU), cytarabine (Ara-C), hydroxyurea antipurine agents: purinethol, thioguanine, pentostatin, cladribine, cytotoxic nucleoside synthesis inducers: gemcitabine, v) a compound chosen from the other groups of tubulin-affinity agents, vinca alkaloids which disrupt the mitotic spindle: vincristine, vinblastine, vindesine, navelbine, agents which block the depolymerization of the mitotic spindle: paclitaxel, docetaxel, agents which induce DNA cleavage by inhibition of topoisomerase II: etoposide, teniposide, topoisomerase I inhibitors which induce DNA cleavage: topotecan, irinotecan, vi) a DNA splitting or fragmenting agent, such as bleomycin, vii) one of the following compounds: plicamycin, L-asparaginase, mitoguazone, dacarbazine, viii) an anticancer progestative steroid; medroxy-progesterone, megestrol, ix) an anticancer estrogen steroid: diethylstilbestrol; tetrasodium fosfestrol, x) an antiestrogen agent: tamoxifen, droloxifen, raloxifen, aminoglutethimide, xi) a steroidal antiandrogenic agent (eg cyproterone) or a non-steroidal antiandrogenic agent (flutamide, nilutamide).

In addition to the API's mentioned herein, the dosage forms of the invention can, in addition or instead, include vitamins, minerals and dietary supplements. As used in this disclosure, the term "vitamin" refers to trace organic substances that are required in the diet. For the purposes of the present invention, the term "vitamin(s)" includes, without limitation, thiamine, riboflavin, nicotinic acid, pantothenic acid, pyridoxine, biotin, folic acid, vitamin $B_{12}$, lipoic acid, ascorbic acid, vitamin A, vitamin D, vitamin E and vitamin K. Also included within the term "vitamin" are the coenzymes thereof. Coenzymes are specific chemical forms of vitamins. Coenzymes include thiamine pyrophosphates (TPP), flavin mononucleotide (FMM), flavin adenine dinucleotide (FAD), Nicotinamide adenine dinucleotide (NAD), Nicotinamide adenine dinucleotide phosphate (NADP), Coenzyme A (CoA), pyridoxal phosphate, biocytin, tetrahydrofolic acid, coenzyme $B_{12}$, lipoyllysine, 11-cis-retinal, and 1,25-dihydroxycholecalciferol. The term "vitamin(s)" also includes choline, carnitine, and alpha, beta, and gamma carotenes.

The term "mineral" refers to inorganic substances, metals, and the like required in the human diet. Thus, the term "mineral" as used herein includes, without limitation, calcium, (calcium carbonate), iron, zinc, selenium, copper, iodine, magnesium, phosphorus, chromium and the like, and mixtures thereof. The term "dietary supplement" as used herein means a substance which has an appreciable nutritional effect when administered in small amounts. Dietary supplements include, without limitation, such ingredients as bee pollen, bran, wheat germ, kelp, cod liver oil, ginseng, and fish oils, amino-acids, proteins and mixtures thereof. As will be appreciated, dietary supplements may incorporate vitamins and minerals.

In general, the amount of active ingredient incorporated in each tablet or dosage form (API, vitamin, mineral, dietary supplement and the like), may be selected according to known principles of pharmacy. An effective amount of API is specifically contemplated. By the term "effective amount," it is understood that, with respect, to for example, a "pharmaceutically effective amount" is contemplated. A "pharmaceutically effective amount" is the amount or quantity of a drug or API which is sufficient to elicit the required or desired therapeutic response, or in other words, the amount which is, sufficient to elicit an appreciable biological response when administered to a patient. As used with reference to a vitamin or mineral, the term "effective amount" means an amount at least about 10% of the United States Recommended Daily Allowance ("RDA") of that particular ingredient for a patient. For example, if an intended ingredient is vitamin C, then an effective amount of vitamin C would include an amount of vitamin C sufficient to provide 10% or more of the RDA. Typically, where the tablet includes a mineral or vitamin, it will incorporate higher amounts, preferably about 100% or more of the applicable RDA.

The amount of active ingredient used can vary greatly. Of course, the size of the dosage form, the requirements of other ingredients, and the number of, for example, tablets which constitute a single dose will all impact the upper limit on the amount of pharmacologically active ingredient which can be used. However, generally, the active ingredient is provided in an amount of between greater than zero and about 80% by weight of the finished tablet and, more preferably, in a range of between greater than zero and about 60% by weight thereof. Put in other terms, the active ingredient can be included in an amount of between about 1 microgram to about 2 grams, and more preferably between about 0.01 and about 1000 milligrams per dosage form, i.e., per tablet.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A medication package comprising:

a blister package including:

a unitary blister sheet defining a plurality of unit package regions, each of the unit package regions including a recess having an open top and a flange surrounding the recess; and a unitary sheet of lidding material peelably sealed to the flanges, the sheet of lidding material having lines of weakness extending at least partially along borders between adjacent unit package regions, the blister sheet and the sheet of lidding material defining unsealed areas along the borders for facilitating peeling of the lidding material from the blister sheet;

a substantially rigid outer sleeve for receiving said blister package, said outer sleeve having:

at least one opening;

locking means for locking said blister package within the sleeve wherein said locking means comprises a post extending from an internal surface of the outer sleeve, the post being configured to extend through an aperture defined by the blister package;

release means for releasing said blister package from the locking means; and retaining means for preventing the blister package from being completely withdrawn from the sleeve, the retaining means comprising a finger extending from the outer sleeve, adjacent the opening, wherein (i) the finger extends at least partially away from the opening, and (ii) the finger is configured to pass through the aperture during withdrawal of the blister package from the sleeve.

2. The medication package according to claim 1, wherein the release means comprises a depressible section of the outer sleeve for engaging the blister package and moving the aperture off of the post.

3. The medication package according to claim 1, wherein the lines of weakness of the lidding material cross one another to define intersections.

4. The medication package according to claim 3, wherein the unsealed areas are located at the intersections of said lines of weakness.

5. The medication package according to claim 1, wherein said outer sleeve is constructed from a polymeric material.

6. The medication package according to claim 1, wherein said recess further includes walls and a closed bottom.

7. The medication package according to claim 6, wherein a dosage form may be disposed in said recess and engages said walls of said recess so that said walls hold said dosage form away from said closed bottom and adjacent said lidding material so that there is an empty space between each said dosage form and said closed bottom of said recess.

8. A packaged dosage form including a package as claimed in claim 1 and a plurality of pharmaceutical dosage forms disposed in said recesses.

9. The packaged dosage form claimed in claim 8, wherein the pharmaceutical dosage forms are fentanyl.

10. A medication package comprising:

a blister package including:

a blister sheet defining a plurality of unit package regions, each of the unit package regions including a recess having an open top and a flange surrounding the recess;

lidding material for covering the recesses peelably sealed to the flanges; and an aperture passing through the blister sheet;

a substantially rigid outer sleeve for receiving said blister package, said outer sleeve having:

at least one opening;

a post that extends from an internal surface of the outer sleeve, the post being configured to extend through the aperture to lock the blister package within the outer sleeve; and a depressible section of the outer sleeve, configured to engage the blister package and move the aperture off of the post; and a finger extending from the outer sleeve, wherein (i) the finger extends at least partially away from the opening, and (ii) the finger is configured to pass through the aperture during withdrawal of the blister package from the sleeve to prevent the blister package from being completely withdrawn from the sleeve.

11. The medication package according to claim 10, wherein the lidding material comprises a unitary sheet having lines of weakness extending along borders between adjacent unit package regions, the blister sheet and the sheet of lidding material defining unsealed areas along the borders for facilitating peeling of the lidding material from the blister sheet.

12. The medication package according to claim 11, wherein the lines of weakness of the lidding material cross one another to define intersections.

13. The medication package according to claim 12, wherein the unsealed areas are located at the intersections of said lines of weakness.

14. The medication package according to claim 10, wherein said outer sleeve is molded from a polymeric material.

15. The medication package according to claim 10, wherein said recess further includes walls and a closed bottom.

16. The medication package according to claim 15, wherein a dosage form may be disposed in said recess and engages said walls of said recess so that said walls hold said dosage form away from said closed bottom and adjacent said lidding material so that there is an empty space between each said dosage form and said closed bottom of said recess.

17. A packaged dosage form including a package as claimed in claim 10 and a plurality of pharmaceutical dosage forms disposed in said recesses.

18. The packaged dosage form claimed in claim 16, wherein the pharmaceutical dosage forms are fentanyl.

* * * * *